US005601348A

United States Patent [19]

Minkovski

[11] Patent Number: 5,601,348

[45] Date of Patent: Feb. 11, 1997

[54] MULTI-CONFIGURATION FURNISHING ELEMENTS

[76] Inventor: Leonid E. Minkovski, 2370 Yosemite, Palm Springs, Calif. 92264

[21] Appl. No.: 413,825

[22] Filed: Mar. 30, 1995

[51] Int. Cl.[6] ..... A47B 83/04

[52] U.S. Cl. ..... 312/237; 312/238; 312/198; 312/203; 312/235.3; 312/235.4; 5/53.2; 5/133; 5/137; 108/42; 108/90

[58] Field of Search ..... 312/237, 238, 312/198, 203, 235.3, 235.4; 108/90, 42, 34, 38, 48, 50; 5/53.1, 53.2, 133, 159.1, 3, 7, 137

[56] References Cited

U.S. PATENT DOCUMENTS

| | | | |
|---|---|---|---|
| 1,304,368 | 5/1919 | Purcell | 297/143 |
| 3,042,978 | 7/1962 | Eames et al. | 108/48 |
| 3,088,127 | 5/1963 | Eames | 108/38 |
| 3,748,010 | 7/1973 | Garte | 108/48 X |
| 4,427,244 | 1/1984 | Castagna | 312/198 X |
| 4,571,756 | 2/1986 | Castro et al. | 5/53.1 |
| 4,793,011 | 12/1988 | Eve | 5/159.1 X |
| 4,995,322 | 2/1991 | Frederick | 108/38 X |
| 5,086,527 | 2/1992 | Takahashi et al. | 108/38 X |
| 5,329,654 | 7/1994 | Sherman | 5/53.2 X |
| 5,353,452 | 10/1994 | Rulis | 5/159.1 X |
| 5,408,936 | 4/1995 | Tseng | 108/42 |
| 5,479,852 | 1/1996 | Lloyd | 108/144 |

*Primary Examiner*—Peter M. Cuomo
*Assistant Examiner*—Stephen Vu
*Attorney, Agent, or Firm*—Henri J. A. Charmasson; John D. Buchaca

[57] ABSTRACT

An assembly comprising one or more stationary wall units, each having a recess into which rigid platform is pivotally mounted. The platform forms a wall portion in its closed position, and a bed or couch in its open position. A second smaller platform or shelf/leg is pivotally mounted with a second recess or well set into the larger platform. The shelf/leg forms a wall portion in its open position, and a shelf or support leg in its open position, depending on the position of the larger platform. The larger platform itself maybe mounted adjacent to and in front of a pivotally mounted bedframe member, thereby allowing a single wall unit to be configured to form either a wall, a wall having an added shelf, a couch or a double bed.

The invention further comprises a height adjustable table allowing both a lower height coffee table and a higher height card table. At its lower height the table can also provide support to the bedframe in its open position. At its upper height, an extension may be attached between an edge of the table and a securing point on a wall unit, thereby forming a desk or project table.

20 Claims, 10 Drawing Sheets

MULTI-CONFIGURATION FURNISHING ELEMENTS

FIELD OF THE INVENTION

This invention relates to furniture and more specifically to household furnishing elements capable of being configured into a plurality of furniture types.

BACKGROUND OF THE INVENTION

Although some members of society suffer from having too much space, the more usual and less rectifiable complaint is that one must cope with not enough space. Both at work and at home, we often desire increased functionality from our available space. Efficient utilization of the available space in any living or working area has been a prime furniture design consideration for centuries. With the increase in the number of people who work from their homes, there is an even greater demand for efficient space utilization.

Generally, people perform different functions at different times in the day. For example, during the day a room may be needed for an office or living room. During the evening, a party room may be needed to entertain guests. At night, a bedroom is preferred., With a limited number of rooms having limited space, it would be advantageous to have a single room performs more than one of these functions. However, traditional, non-configurable furniture may not adequately fulfill all these functions.

One way to more efficiently use the available space in a room is to provide furnishing elements which are configurable into more than one type of furniture, depending on the function required by the user. One device which has been in use for decades is the so-called Murphy Bed. Basically, this device consists of a mattress and platform structure which is pivotally mounted within a recess of a wall. In the folded down, extended position, the mattress and platform form a bed. In the folded up, contracted position, the mattress is hidden with the recess, while the undersurface of the platform forms a portion of the wall.

Prior art devices, such as the Murphy Bed and other systems for assembling temporary or semi-permanent living space furniture suffer from a lack of versatility in that they allow the construction of too few basic configurations. Any deviation from those basic configurations require use of additional hardware which increases assembly time detracts from the styling unity of the original design and greatly increases the tooling and installation costs. Many of the prior art systems resort to a large number of components which increase the complexity of the assembly. Most significantly, many prior art systems lack in dimensional consistency between different arrangements of standard elements. The present invention results from a comprehensive attempt to resolve those problems.

SUMMARY OF THE INVENTION

The principal and secondary objects of this invention are to provide furnishing elements which are configurable into a multitude of furniture types.

These and other objects are achieved by a wall unit having a recess into which is mounted a first extendable platform. This platform forms a bed or couch in its down, open, extended position, and a wall in its up, closed, retracted position. A second recess or well is set into the lower/outer surface of the first platform. A second, smaller platform is pivotally mounted within the well so that in its extended position, the second platform forms a support leg for the bed/couch or a shelf for the wall, depending on whether the first platform is extended or retracted.

The platform itself maybe mounted adjacent to and in front of an extendable bedframe member, thereby allowing a single wall unit to be configured to form either a wall, a wall having an added shelf, a couch or a double bed.

The invention further comprises a height adjustable table allowing both a lower height coffee table and a higher height card table. At its lower height the table can also provide support to thee platform in its open, extended position. At its upper height, an extension may be attached between an edge of the table and a securing point on the outer surface of the first platform in the closed, retracted position, thereby forming a desk or project table.

Two or more wall units, in a linear or corner filling style, each with a folding platform apparatus, may be utilized in a single room to provide greater variation in the room's functional possibilities.

In its simplest and broadest embodiment, the invention takes the Murphy Bed device one step further by providing a foldable leg support structure which doubles as a shelf when the bed is in the up and closed configuration. In its more detailed embodiment, the invention provides elements which are configurable into a multitude of furniture types which serve numerous functions.

DESCRIPTION OF THE PREFERRED EMBODIMENT OF THE INVENTION

Figure 1:
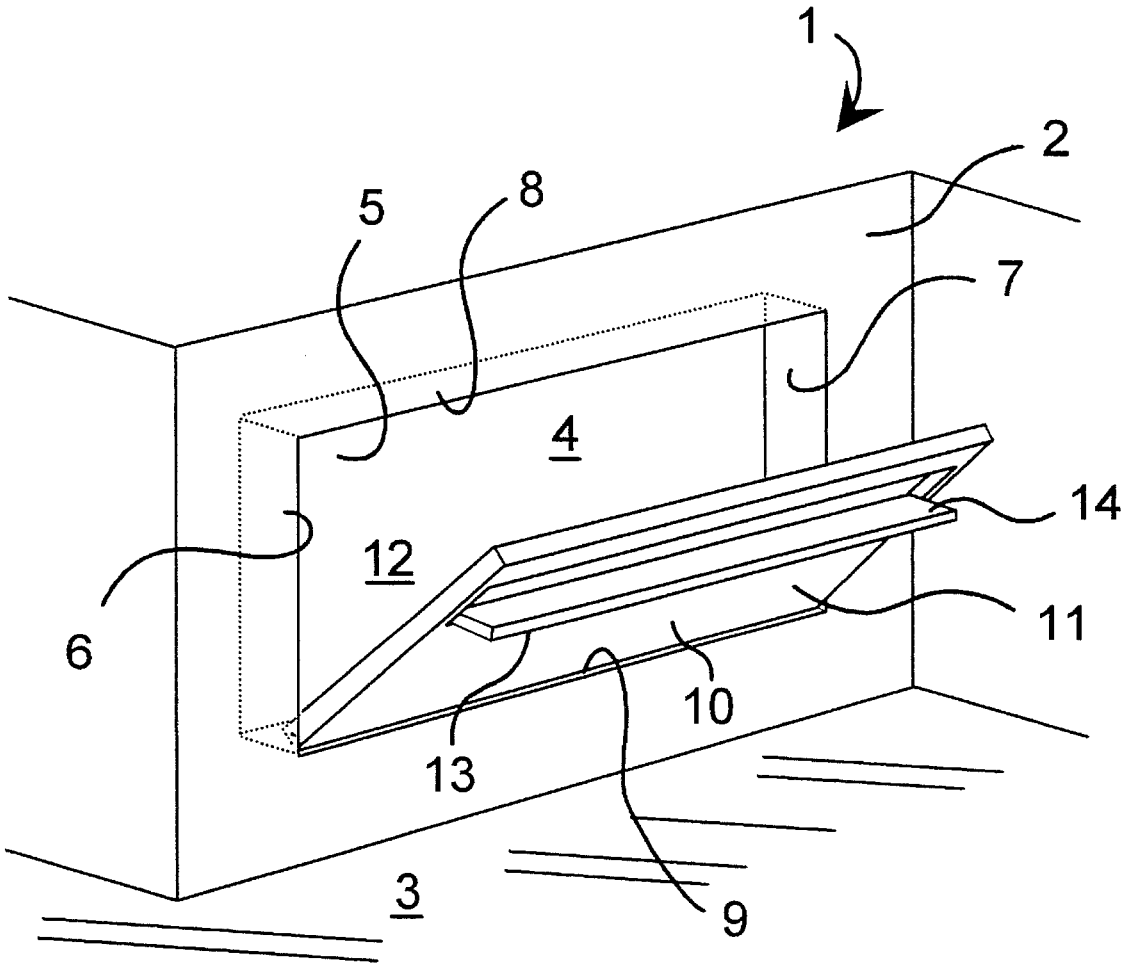
FIG. 1 is a perspective and partially transparent view of a single wall unit having a folding platform apparatus according to the invention.

Referring now to the drawing, FIG. 1 shows a wall unit 1 having a substantially planar and vertical facade 2 orthogonally projecting up from a floor 3 of a living space. In this case the wall unit is an actual wall of the room. However, the term "wall unit" can also include free standing or anchored bookshelf type structures. A recess 4 is set into the wall unit. The recess has a back wall 5, oppositely facing side Walls 6,7, and oppositely facing top 8 and bottom 9 walls. The recess has a substantially rectangular opening, however any closed, functional, and aesthetically appealing Shape is possible. A rigid platform 10 is pivotally mounted to the wall unit within a lower portion of the recess, allowing the platform to move angularly between a vertical closed position and a horizontal open position. The platform has substantially orthogonal length, width and thickness dimensions. These dimensions are smaller than the dimensions of the recess in the wall unit. An outer surface 11 of the platform faces outward when the platform is in the up, retracted or closed position and faces downward when the platform is in the down, extended or open position. While in the closed position the surface lies substantially within the plane of the facade of the wall unit.

Within the platform and extending inwardly from the outer surface is a recessed well 12 extending along the length dimension of the platform. In this case the well is structurally similar to the recess, having back, top, bottom and two side walls. However, the dimensions of the well must necessarily be less than the dimensions of the platform.

A rigid shelf/support leg member 14 (shelf/leg) is pivotally mounted to the platform within a lower portion of the well, allowing the shelf/leg to move angularly between a closed position and an open position. In the closed position, an outer face 13 of the shelf/leg lies substantially within the plane of the outer surface 11 of the platform. In the open position, the outer face of the shelf/leg is substantially orthogonal to the outer surface of the platform.

Figure 2:
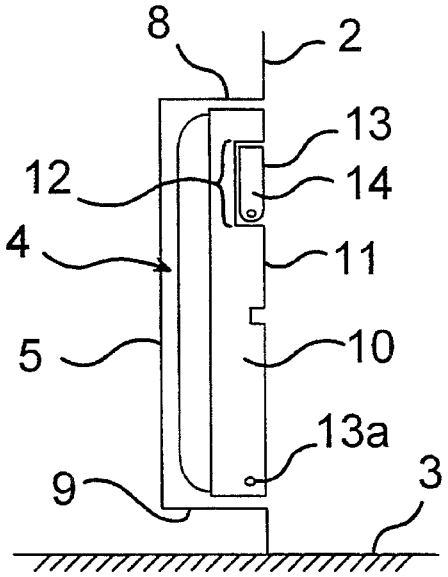
FIG. 2 is a functionally diagrammatic side view of the wall unit/platform assembly in the retracted wall configuration.

Referring now to FIG. 2, there is shown a more detailed and functionally diagrammatic side view of the wall unit/platform assembly of FIG. 1. There is shown the wall unit's facade 2 projecting up from a floor 3. A recess 4 extends a distance inward from the facade. The top 8, bottom 9 and back 5 walls of the recess are shown. A rigid platform 10 is pivotally mounted within the recess of the wall unit. Mounting is accomplished through means of a hinge 13*a* connecting the platform to the wall unit.

The means for pivotally mounting may be accomplished through any number of hinge type mechanisms disclosed in the art. In this case, the hinge mechanism comprises a pair of cylindrical axles having a common axis of rotation jutting out from opposite ends of the platform. These axles are rotatively supported by a pair of bearings in the form of a pair of circular holes, each set into an opposite side wall of the recess. This is certainly not the only means for pivotally mounting the platform. Other means well known in the art are adequate as well. These include, but are not limited to, those mechanisms having dynamic points of rotation which are commonly used in folding couch/beds.

In FIG. 2, the platform 10 is shown in the vertical closed position. The shelf/leg member 14 is also in the closed position. This allows the outer face 13 of the shelf, the outer surface 11 of the platform and the facade 2 of the wall unit to lie substantially within the same plane thereby providing a wall-type configuration to the assembly.

Figure 3:
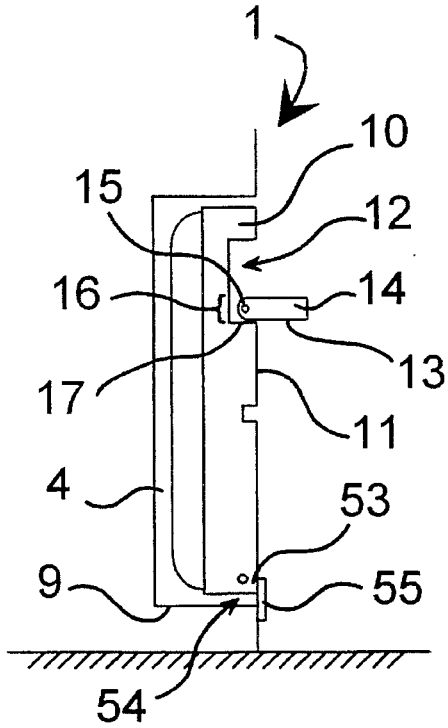
FIG. 3 is a functionally diagrammatic side view of the assembly of FIG. 2 in the shelf configuration.

FIG. 3 shows the wall unit/platform assembly 1 where the shelf/leg member 14 has been folded down from its closed position to an open position where its outer face 13 is now substantially orthogonal to the outer surface 11 of the platform 10. This is referred to as the shelf configuration of the assembly. In this embodiment the hinge 15 connecting the shelf/leg to the platform is located in a lower portion 16 of the well 12 so that when the shelf/leg is in the open position, the shelf/leg is supported by contacting the bottom wall 17 of the well. However, the hinge or other means for pivotally mounting the shelf/leg may be located elsewhere on the platform so long as there are means for accommodating the downward vertical force of a load placed on the shelf/leg member when it is in the shelf configuration.

Figure 4:
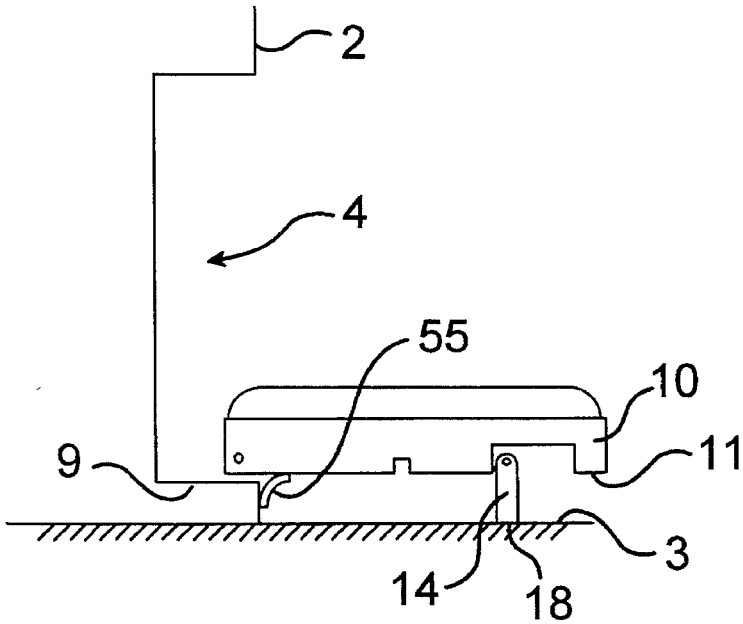
FIG. 4 is a functionally diagrammatic side view of the assembly of FIG. 2 in the bed configuration.

FIG. 4 shows both the platform 10 and the shelf/leg member 14 in the open position providing the couch or single bed configuration to the assembly. Here, the outer surface 11 of the platform lies substantially parallel to the floor 3 and orthogonal to the facade 2 of the wall unit. The edge 18 of the shelf/leg member engages the floor, providing support for the platform, thereby preventing further movement of the surface toward the floor.

Figure 5:
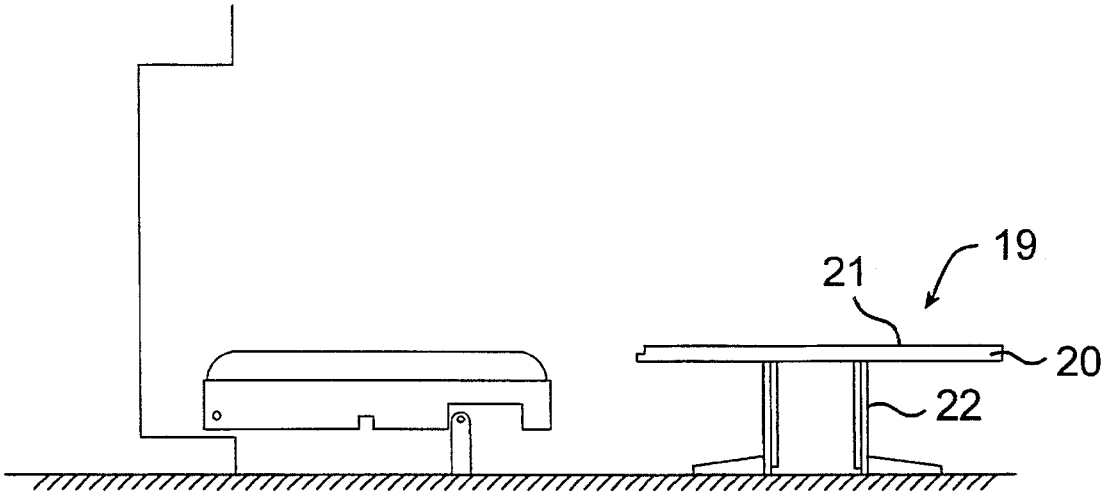
FIG. 5 is a functionally diagrammatic side view of the wall unit/platform assembly in the bed configuration and a height-adjustable table in the coffee table configuration.

FIG. 5 shows the wall unit/platform assembly in the couch or single bed configuration and a height-adjustable table 19 which is in a coffee table configuration. The table comprises a top platter 20 member having a substantially horizontal and substantially planar upper surface 21. The table also has a leg member 22 which supports the platter a distance above the floor.

Figure 6:
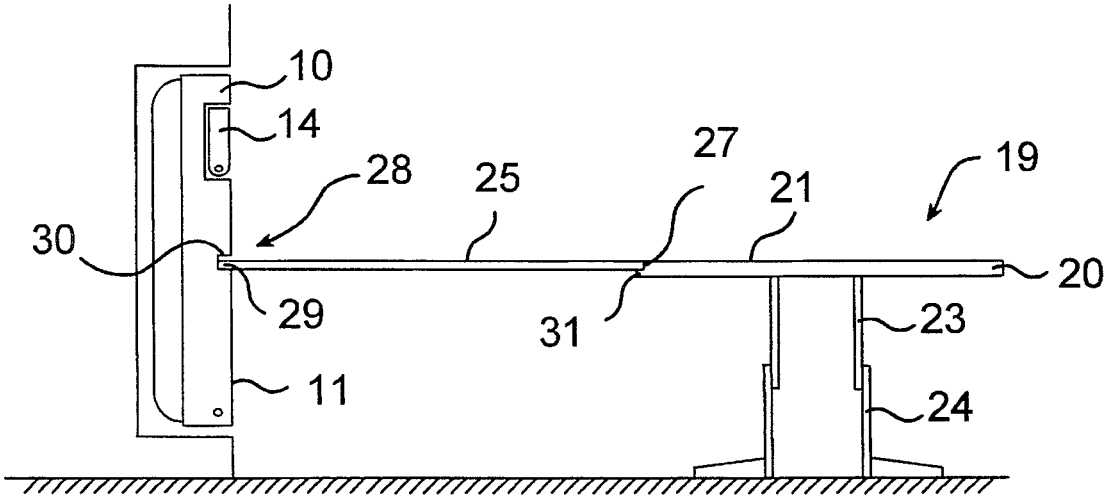
FIG. 6 is a functionally diagrammatic side view of the wall unit/platform assembly in the wall configuration having an extension to the table in the desk configuration.

FIG. 6 shows that the height of the table 19 can be adjusted to place the table in a desk configuration with the platter 20 supported at a greater distance above the floor. The table is height adjustable through means of telescoping portions 23,24 of the leg member. Of course the maximum height of the table having only two telescoping portions would not be greater than two times the minimum height. However, tables using more telescoping portions can be capable of greater variation in platter height. Telescoping legs are certainly not the only means for providing the table with a height adjustable platter. Other means well known in the art are adequate as well. These include, but are not limited to, folding legs or scissor style legs common in ironing boards.

Also shown in FIG. 6 is a substantially planar extension member 25 is mounted between the platter 20 in its high position and the platform 10 and shelf/leg 14 in their closed positions, so as to extend the planar upper surface 21 of the platter. The extension attaches between an edge 27 of the table and a securing point 28 on the wall unit/platform assembly in its wall or shelf configuration. This provides the desk Configuration to the invention. One or more extensions may be used to increase the upward facing surface area of the table. Means for releasably connecting the ends of the extension to the platform and to the platter may simply require resting a first end 29 of the extension on an upward-facing surface of a notch 30 set into the outer surface 11 of the platform and an upward-facing surface of an extended lip 31 from the platter. Many other means for attaching the extension are well-known in the art. These include, but are not limited to, detachable clamps, prongs engaging holes and tongue-in-groove mechanisms.

Figure 7:
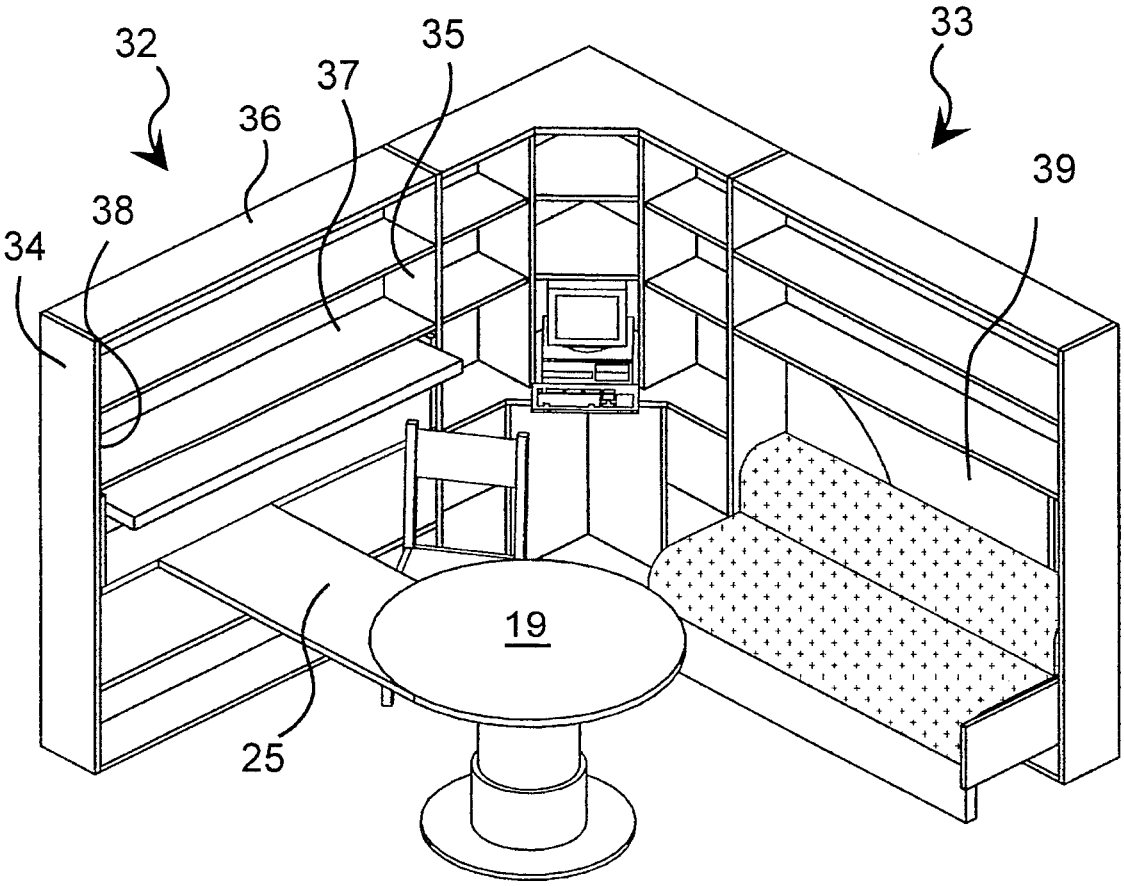
FIG. 7 is a perspective view of the dual wall arrangement having two foldable wall unit/platform assemblies in a corner-filling arrangement.

FIG. 7 shows the invention having more than one wall unit/platform assemblies arranged in a corner-style configuration. In this case, each wall unit 32,33 is a free standing or anchored bookshelf type structure having substantially vertical Support members 34,35 and rigidizing, substantially horizontal cross members 36, 37. Here, the facade of each wall unit is the substantially planar forward terminating edge 38 of the support members and cross-members. A first wall unit/platform assembly 32 is in the shelf configuration providing support for the table 19 having a single extension 25 mounted to form the desk configuration. A second extension 39 which could be mounted next to the first extension to form the project table configuration is shown stored within the recess of a second wall unit/platform assembly 33. The second wall unit/platform assembly is in the folded down couch or single bed configuration.

Figure 8:
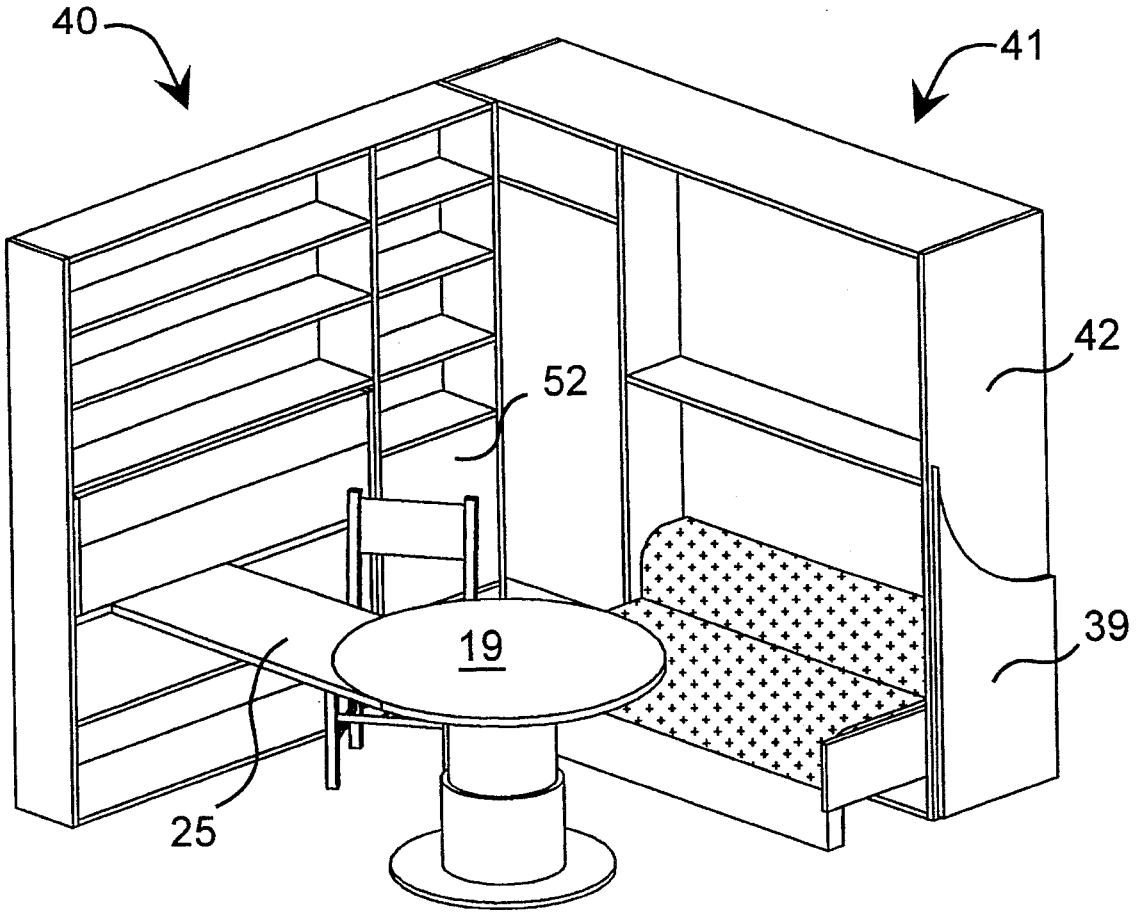
FIG. 8 is a perspective view of the invention having a multiple wall unit approach wherein a first wall unit/platform assembly is in the shelf configuration with a table and an extension in the desk configuration, and a second wall unit/bedframe/platform assembly is in the couch configuration with the bedframe in the up position and the platform in the down position.

FIG. 8–13 show a further embodiment of the invention wherein the platform is pivotally mounted to a bedframe which in turn, is pivotally mounted to the wall unit. FIG. 8 shows first 40 and second 41 wall units arranged in a corner-style configuration. A first wall unit/platform assembly 40 is identical to those described earlier. It is shown in the shelf configuration providing support for an extension 25 running to the table 19 in the desk configuration. The second wall unit/platform assembly 41 is shown in the folded down couch or single bed configuration. A second extension 39 or the table is shown stored on one of the vertical supports 42 of the second wall unit assembly. Other optional features of a wall unit such as closets, shelves and cabinets may be formed adjacent to the wall unit/platform assembly. Here, a cabinet having a cabinet door 52 is shown.

Figure 9:
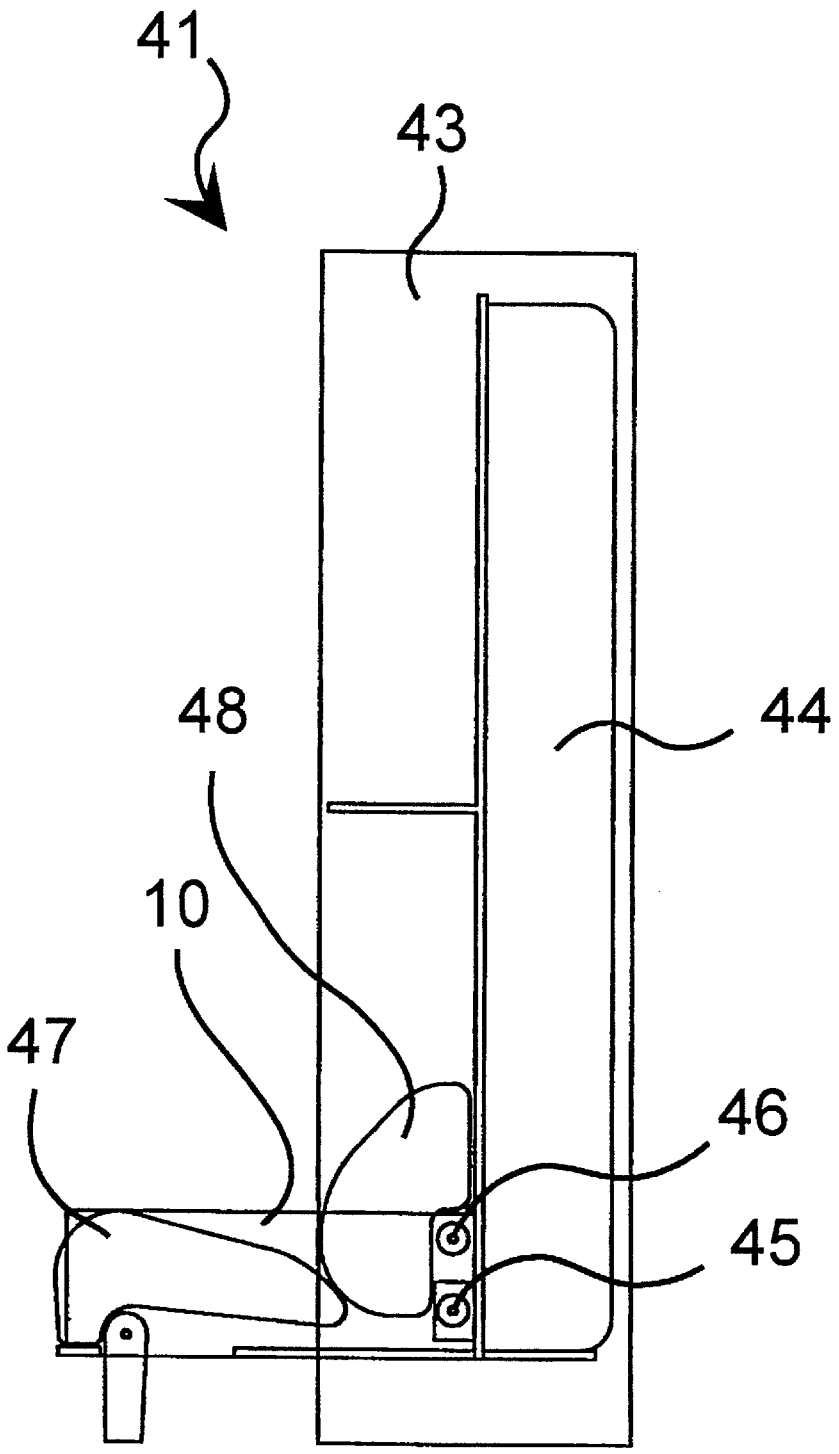
FIG. 9 is a functionally diagrammatic side view of the wall unit/bedframe/platform assembly in the open couch configuration.
Figure 10:
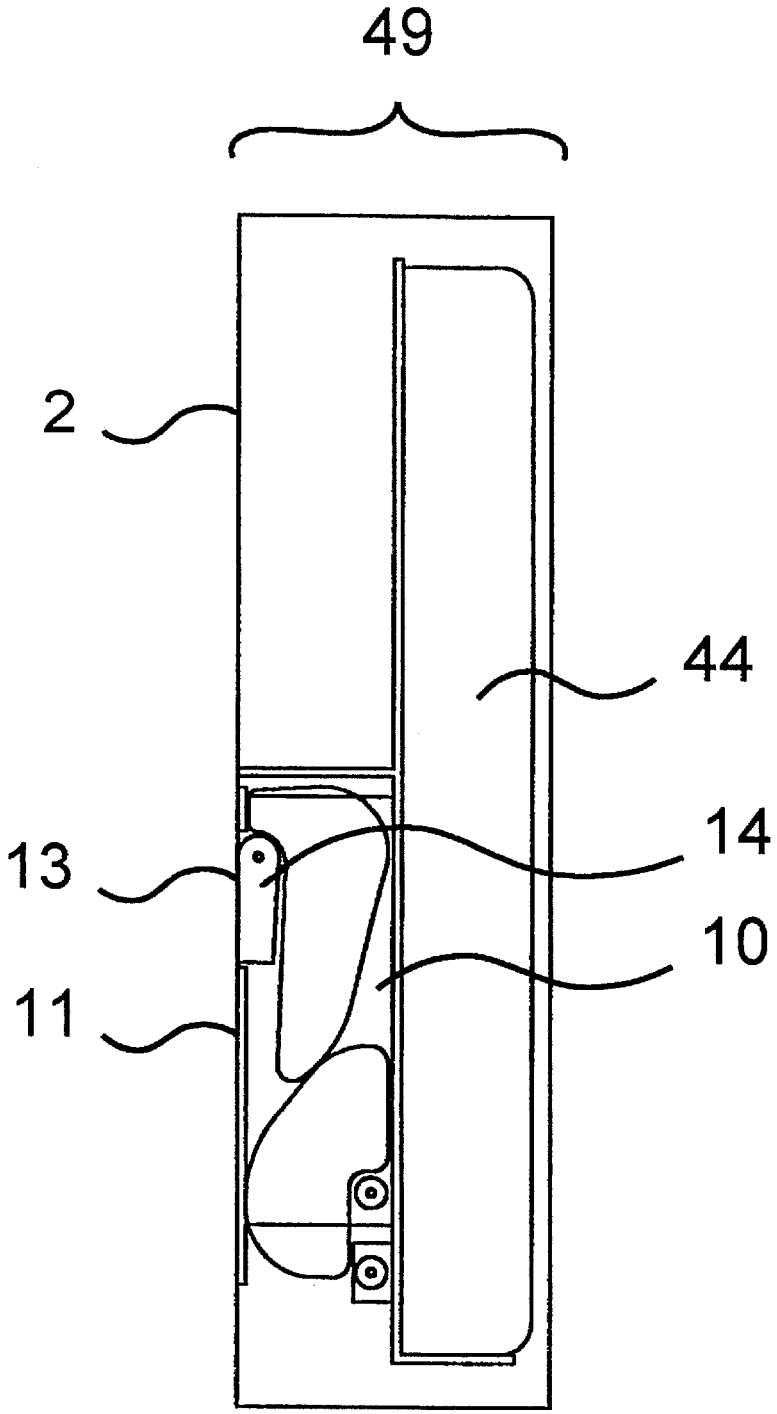
FIG. 10 is the assembly of FIG. 9 in the closed wall configuration.
Figure 11:
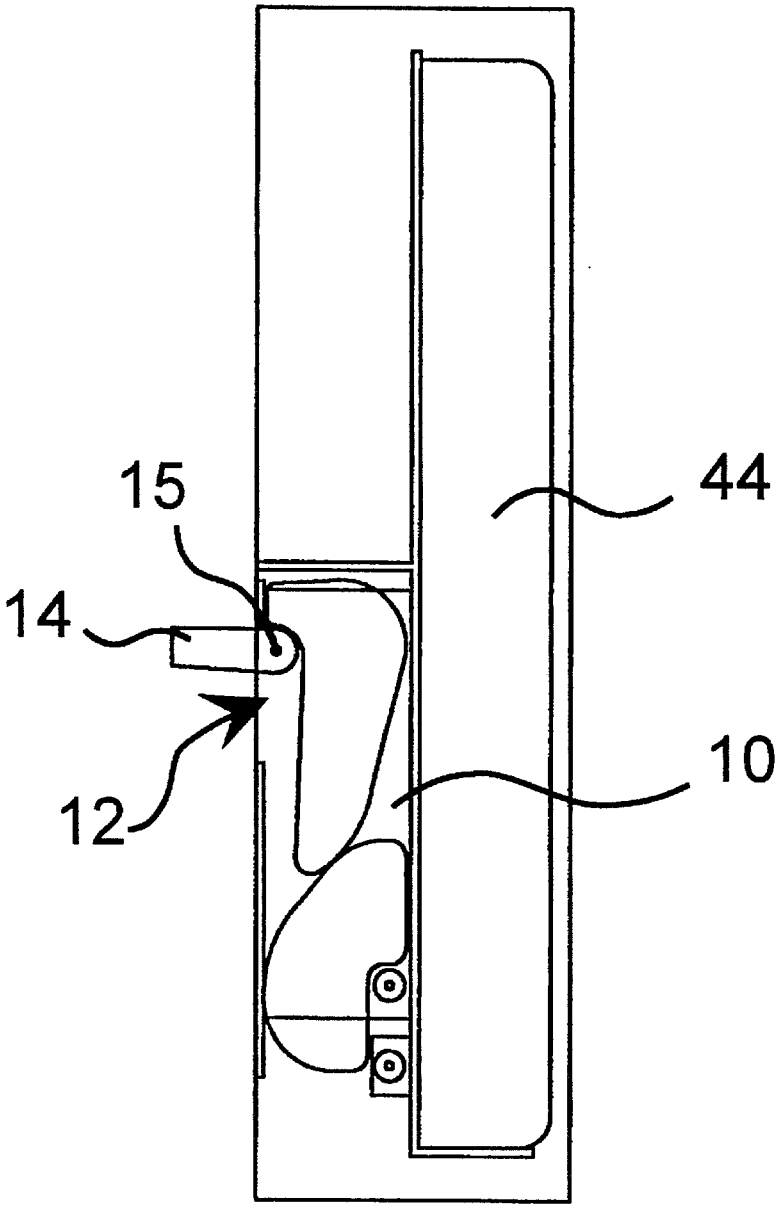
FIG. 11 is the assembly of FIG. 9 in the shelf configuration.

The second wall unit assembly 41 of FIG. 8 is shown in a functionally diagrammatic side view in FIGS. 9–11. This assembly provides different means for pivotally mounting the platform 10 to the wall unit 43. Here, the platform is mounted to an extendable bed-frame member 44 which itself is pivotally mounted to the wall unit through means of a bedframe hinge 45. The platform is pivotally mounted to the bedframe (and thus the wall unit) through means of a platform hinge 46.

In FIG. 9, the bedframe is in the up and closed position, while the platform is in the down and open position. The platform forms the seat cushion portion 47 of a couch, with the backrest 48 firmly attached to the underside of the bedframe. The backrest and seat cushion are roughly orthogonal to one another in the couch configuration.

In FIG. 10, the bedframe 44, the platform 10 and the shelf/leg 14 are all in the closed position, thereby forming the wall configuration. The platform has an outer surface 11 and the shelf/leg has an outer face 13 which both lie substantially within the plane of the facade 2 of the wall unit. Since both the bedframe and the platform must fit within the recess when the assembly is in the wall configuration, the combined thickness dimension of the platform and bedframe must be less than the depth 49 of the recess.

FIG. 11 shows the wall unit/bedframe/platform assembly in the shelf configuration, with the bedframe 44 and platform 10 closed and the shelf/leg 14 open. Note the shelf/leg hinge 15 connecting the shelf/leg to the platform is located in an upper portion of the well 12. In order for shelf/leg member to support the downward vertical force of a load placed on the shelf when it is in the shelf configuration, means disclosed in the art must be provided for biasing or locking the shelf/leg in the open position. These means can include, but are not limited to, the use of springs, locking members or a tightly toleranced shelf-to-well interface.

Figure 12:
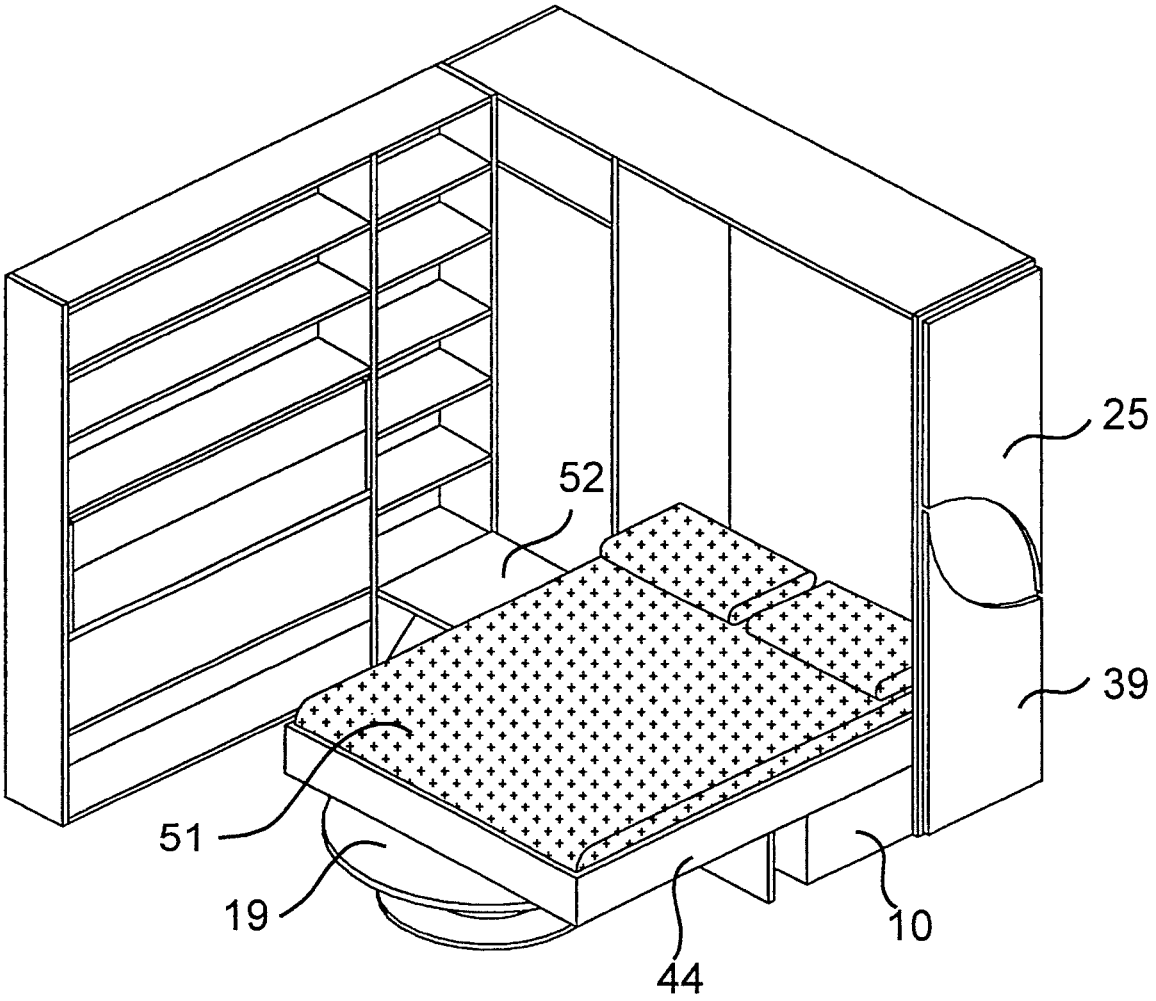
FIG. 12 is a perspective view of the multiple wall unit approach of FIG. 8 wherein the wall unit/bedframe/platform assembly is in the double bed configuration.
Figure 13:
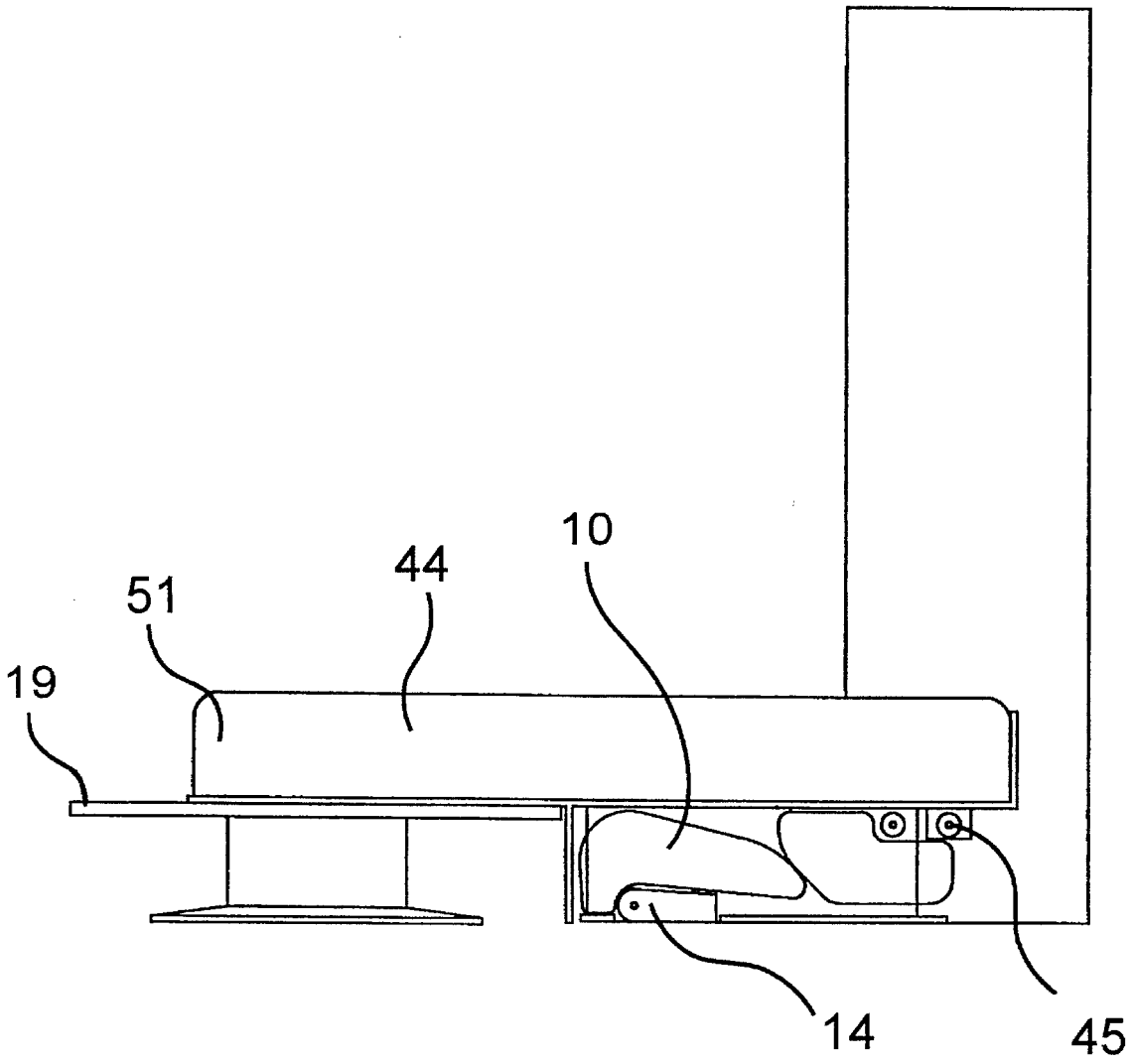
FIG. 13 is a functionally diagrammatic side view of the wall unit/bedframe/platform assembly in the double bed configuration.

FIG. 12 and 13 show that the bedframe 44 and platform 10 combination can revolve about the bedframe hinge 45 to bring the bedframe into the double bed configuration. With the platform 10 and the shelf/leg 14 remaining in their closed positions, they are conveniently stowed beneath the bedframe providing additional support. Here, the foot of the bed 51 which is an end portion of the bedframe is supported by the table 19 in coffee table configuration. This configuration also shows that the table extensions 25,39 may be stored conveniently along an outer surface of the wall unit. In addition, the cabinet door may be folded down to form a nightstand 52.

Various hinge mechanisms may be employed to provide certain elements with the ability to pivot without being interfered by other elements or structures. Some corners may be rounded and some panels radiused or angled to facilitate movement between configurations. In addition, aesthetically appealing flaps and other structures may be used to obscure apertures and other features exposed by some configurations without departing from the invention. For example, referring back to FIGS. 3 and 4, to prevent interference between an outer lower corner 53 of the platform 10 and the bottom wall 9 of the recess 4 during conversion from the Wall configuration to the couch configuration, the corner may be radiused and/or a space 54 may be formed between the bottom wall and the platform. If these features are not deemed aesthetically appealing, they may be hidden through means such as an attached flexible flap 55.

The key to providing all of these configurations requires the elements of the assembly be constructed with dimensional consistency. Lengths, widths and depths of each element must be carefully chosen such that it conforms with and accommodates other elements in every configuration. For example, the shelf/leg dimensions must allow it to act as a support leg when the platform is in the couch position; the platform must fit between the floor and the bedframe in the double bed configuration; and nightstand/cabinet door must fit between the bedframe and the facade of an orthogonal wall unit. These restrictions are apparent from the drawing and this specification.

While the preferred embodiments of the invention have been described, modifications can be made and other embodiments may be devised without departing from the spirit of the invention and the scope of the appended claims.

What is claimed is:

1. A multi-configuration furniture assembly having a plurality of compatibly dimensioned components comprising:

a substantially stationary wall unit structure having an outer facade substantially orthogonal to a floor;

a recess extending behind said outer facade;

a rigid platform;

means for pivotally mounting said platform to said wall unit, thereby allowing angular movement of said platform with respect to said wall unit between a first closed position and a second open position;

said platform having an outer surface and a well set into said outer surface;

a rigid shelf pivotally mounted to said platform thereby allowing angular movement of said shelf between a first closed state and a second open state with respect to said platform;

wherein while said platform is in said second open position and said shelf is in said second open position state, said shelf contacts a floor and provides support to said platform, resisting further movement of said platform toward a floor;

wherein while said platform is in said first closed position and said shelf is in said second open state, a substantially planar surface of said shelf is oriented substantially parallel to a floor;

said shelf being retractable into said well;

wherein said shelf has an outer face; and wherein said outer face, said outer facade and said outer surface lie substantially within a first plane when said platform is in said first closed position and said shelf is in said first closed state;

wherein said means for pivotally mounting said platform to said wall unit comprise:

a bedframe;

means for pivotally mounting said bedframe to said wall unit, allowing angular movement of said bedframe with respect to said wall unit between an up position and a down position; and means for pivotally mounting said platform to said bedframe, allowing angular movement of said platform with respect to said bedframe;

wherein:

said means for pivotally mounting said bedframe to said wall unit comprise a first hinge;

said means for pivotally mounting said platform to said bedframe comprise a second hinge; and said first and second hinges being positioned within a second plane orthogonal to a floor when said bedframe is in said up position. position and said shelf is in said first closed state.

2. The assembly of claim 1, wherein said angular movement of said shelf is substantially 90 degrees.

3. The assembly of claim 1, wherein said angular movement of said platform is substantially 90 degrees.

4. The assembly of claim 1, wherein said outer face, said outer surface, and said outer facade are exposed when said platform is in said first closed position and said shelf is in said first closed state.

5. The assembly of claim 1, wherein said first plane is vertical.

6. The assembly of claim 1, wherein said platform is substantially planar having mutual orthogonal length, width and thickness dimensions, said depth dimension being less than a first depth of said recess.

7. The assembly of claim 1, which further comprises:

a table comprising a top platter member having a substantially horizontal and substantially planar upper surface; and means for supporting said platter at first and second distances above a floor.

8. The assembly of claim 7, wherein said first distance is substantially equal to a third distance between said floor and a lower portion of said bedframe when said bedframe is in said down position.

9. The assembly of claim 7, wherein said means for supporting said platter comprise a height adjustable leg member.

10. The assembly of claim 7, which further comprises:

a first extension having a substantially planar upper surface;

a connection point on said platform;

means for attaching a first end of said first extension to said platter;

means for attaching a second end of said first extension to said connection point; and wherein said means for attaching allow said upper surface of said first extension and said upper surface of said platter to lie substantially within a third plane.

11. The assembly of claim 1, wherein said platter has a first curved edge and said extension has a second curved edge, wherein said first curved edge interlocks and mates with said second curved edge.

12. The assembly of claim 11, which further comprises:

a second extension having a substantially planar upper surface; and means for attaching said second extension to said wall unit and said platter adjacent to said first extension, wherein said upper surface of said second extension lies within said first plane.

13. The assembly of claim 1, which further comprises:

a backrest firmly attached parallel to a planar undersurface of said bedframe;

wherein said backrest is adjacent and substantially orthogonal to a cushioned upper surface of said platform when said bedframe is in said down position and said platform is in said first open position.

14. A multi-configuration furniture assembly having a plurality of compatibly dimensioned components comprising:

a substantially stationary wall unit structure having an facade substantially orthogonal to a floor;

a recess extending behind outer facade;

a rigid platform;

means for pivotally mounting said platform to said wall unit, thereby allowing angular movement of said platform with respect to said wall unit between a first closed position and a second open position;

said platform having an outer surface and a well set into said outer surface;

a rigid shelf pivotally mounted to said platform thereby allowing angular movement of said shelf between a first closed state and a second open state with respect to said platform;

wherein while said platform is in said second open position and said shelf is in said second open position state, said shelf contacts a floor and provides support to said platform, resisting further movement of said platform toward said floor;

wherein while said platform is in said first closed position and said shelf is in said second open state, a substantially planar surface of said shelf is oriented substantially parallel to a floor;

said shelf being retractable into said well;

wherein said shelf has an outer face;

wherein said outer face, said outer facade and said outer surface lie substantially within a first plane when said platform is in said first closed position and said shelf is in said first closed state; and wherein no portion of said assembly is positioned anterior to said first plane when said platform is in said first closed.

15. The assembly of claim 14, wherein said outer face, said outer surface, and said outer facade are exposed when said platform is in said first closed position and said shelf is in said first closed state.

16. The assembly of claim 14, which further comprises:

a table comprising a top platter member having a substantially horizontal and substantially planar upper surface; and means for supporting said platter at first and second distances above said floor.

17. The assembly of claim 16, wherein said means for supporting said platter comprise a height adjustable leg member.

18. The assembly of claim 16, which further comprises:

a first extension having a substantially planar upper surface;

a connection point on said platform;

means for attaching a first end of said first extension to said platter;

means for attaching a second end of said first extension to said connection point; and wherein said means for attaching allow said upper surface of said first extension and said upper surface of said platter to lie substantially within a third plane.

19. The assembly of claim 18, wherein said platter has a first curved edge and said extension has a second curved edge, wherein said first curved edge interlocks and mates with said second curved edge.

20. The assembly of claim 19, which further comprises:

a second extension having a substantially planar upper surface; and means for attaching said second extension to said wall unit and said platter adjacent to said first extension, wherein said upper surface of said second extension lies within said first plane.

* * * * *